US010872562B2

(12) United States Patent
Na

(10) Patent No.: US 10,872,562 B2
(45) Date of Patent: Dec. 22, 2020

(54) PIXEL AND ORGANIC LIGHT EMITTING DISPLAY DEVICE INCLUDING THE SAME

(71) Applicant: SAMSUNG DISPLAY CO., LTD., Yongin-Si (KR)

(72) Inventor: Ji Su Na, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 11 days.

(21) Appl. No.: 16/279,109

(22) Filed: Feb. 19, 2019

(65) Prior Publication Data

US 2019/0259331 A1 Aug. 22, 2019

(30) Foreign Application Priority Data

Feb. 19, 2018 (KR) ..... KR10-2018-0019360

(51) Int. Cl.
*G09G 3/3233* (2016.01)

(52) U.S. Cl.
CPC ... *G09G 3/3233* (2013.01); *G09G 2300/0809* (2013.01); *G09G 2310/0297* (2013.01); *G09G 2310/08* (2013.01)

(58) Field of Classification Search
CPC ... G09G 2300/0809; G09G 2300/0814; G09G 2300/0819; G09G 2310/0297; G09G 2310/08; G09G 2320/0626; G09G 3/3233
See application file for complete search history.

(56) References Cited

U.S. PATENT DOCUMENTS

| | | | | |
|---|---|---|---|---|
| 7,973,746 | B2 | 7/2011 | Han et al. | |
| 8,797,314 | B2 | 8/2014 | Chung et al. | |
| 8,928,642 | B2 * | 1/2015 | Chung | G09G 3/3233 345/211 |
| 2007/0024543 | A1 * | 2/2007 | Chung | G09G 3/3291 345/76 |
| 2017/0069235 | A1 * | 3/2017 | Lee | G09G 3/3291 |

FOREIGN PATENT DOCUMENTS

| | | |
|---|---|---|
| KR | 10-0897172 | 5/2009 |
| KR | 10-1058116 | 8/2011 |
| KR | 10-1768473 | 8/2017 |

* cited by examiner

*Primary Examiner* — Afroza Chowdhury
(74) *Attorney, Agent, or Firm* — F. Chau & Associates, LLC

(57) ABSTRACT

A pixel includes an OLED, a driving transistor, first to third transistors, and a first capacitor. The driving transistor controls an amount of current supplied from a first power source to the OLED. The first power source is coupled to a first electrode of the driving transistor. The current corresponds to a voltage of a first node. The first transistor is coupled between a data line and a second node. The first capacitor is coupled between the first node and the second node. The second transistor is coupled between the first node and a second electrode of the driving transistor. The third transistor is coupled between the first node and an initialization power source. A turn-on time of the first and second transistors overlaps that of the third transistor.

20 Claims, 11 Drawing Sheets

PIXEL AND ORGANIC LIGHT EMITTING DISPLAY DEVICE INCLUDING THE SAME

CROSS-REFERENCE TO RELATED APPLICATIONS

This application claims priority under 35 U.S.C. § 119 to Korean Patent Application No. 10-2018-0019360 filed on Feb. 19, 2018, the disclosure of which is incorporated by reference herein in its entirety.

TECHNICAL FIELD

Exemplary embodiments of the present disclosure relate to a pixel, and an organic light emitting display device including the same.

DISCUSSION OF THE RELATED ART

Organic light emitting display devices display images using organic light emitting diodes (OLEDs) that generate light by recombination of electrons and holes. Organic light emitting display devices have a high response speed and high resolution.

Organic light emitting display devices include pixels, a data driver for supplying a data signal to the pixels, a scan driver for supplying a scan signal to the pixels, and an emission driver for supplying an emission control signal to the pixels.

SUMMARY

According to an exemplary embodiment of the present disclosure, a pixel includes an organic light emitting diode, a driving transistor, first to third transistors, and a first capacitor. The driving transistor is configured to control an amount of current supplied from a first power source to the organic light emitting diode. The first power source is coupled to a first electrode of the driving transistor, and the current corresponds to a voltage of a first node. The first transistor is coupled between a data line and a second node. The first transistor includes a gate electrode coupled to an ith scan line (i is a positive integer). The first capacitor is coupled between the first node and the second node. The second transistor is coupled between the first node and a second electrode of the driving transistor, and includes a gate electrode coupled to the ith scan line. The third transistor is coupled between the first node and an initialization power source, and includes a gate electrode coupled to an ith initialization control line. A turn-on time of the first and second transistors overlaps a turn-on time of the third transistor.

In an exemplary embodiment, the turn-on time of the first and second transistors is longer than the turn-on time of the third transistor.

In an exemplary embodiment, the pixel further includes a fourth transistor coupled between the second node and the initialization power source, and a fifth transistor coupled between the initialization power source and the organic light emitting diode. The fourth transistor includes a gate electrode coupled to an (i+2)th initialization control line, and the fifth transistor includes a gate electrode coupled to the (i+2)th initialization control line.

In an exemplary embodiment, the pixel further includes a fourth transistor coupled between the second node and the initialization power source, and a fifth transistor coupled between the initialization power source and the organic light emitting diode. The fifth transistor includes a gate electrode coupled to the (i+3)th initialization control line, and the fourth transistor includes a gate electrode coupled to an (i+3)th initialization control line.

In an exemplary embodiment, the pixel further includes a sixth transistor coupled between the organic light emitting diode and the second electrode of the driving transistor, and a second capacitor coupled between the first node and the first power source. The sixth transistor includes a gate electrode coupled to an emission control line.

According to an exemplary embodiment of the present disclosure, an organic light emitting display device includes a plurality of pixels, a plurality of scan lines, a plurality of data lines, and a plurality of initialization control lines. The pixels are coupled to the scan lines, the data lines, and the initialization control lines. The organic light emitting display device further includes a scan driver configured to supply a scan signal to the scan lines, a data driver configured to supply a data signal to the data lines, and an initialization driver configured to supply an initialization control signal to the initialization control lines. Each of the pixels includes an organic light emitting diode, and a driving transistor configured to control an amount of current supplied from a first power source to the organic light emitting diode. The first power source is coupled to a first electrode of the driving transistor, and the current corresponds to a voltage of a first node. The pixel further includes a first transistor coupled between a data line and a second node. The first transistor includes a gate electrode coupled to an ith scan line (i is a positive integer). The pixel further includes a first capacitor coupled between the first node and the second node, and a second transistor coupled between the first node and a second electrode of the driving transistor. The second transistor includes a gate electrode coupled to the ith scan line. The pixel further includes a third transistor coupled between the first node and an initialization power source. The third transistor includes a gate electrode coupled to an ith initialization control line. During a first period of one frame, the scan signal supplied to the ith scan line and the initialization control signal supplied to the ith initialization control line overlap each other.

In an exemplary embodiment, the one frame includes a second period subsequent to the first period, and the scan driver supplies the scan signal to the ith scan line during the first period and the second period.

In an exemplary embodiment, the initialization driver supplies the initialization control signal to the ith initialization control line during the first period.

In an exemplary embodiment, the one frame further includes a third period subsequent to the second period, and the initialization driver supplies the initialization control signal to an (i+2)th initialization control line during the third period.

In an exemplary embodiment, the one frame further includes a third period subsequent to the second period, and the initialization driver supplies the initialization control signal to an (i+3)th initialization control line during the third period.

In an exemplary embodiment, the organic light emitting display device further includes an emission driver configured to supply an emission control signal to a plurality of emission control lines coupled to the pixels.

In an exemplary embodiment, the one frame further includes a fourth period subsequent to the third period, and the emission driver supplies the emission control signal to an ith emission control line during the fourth period.

In an exemplary embodiment, each of the pixels further includes a fourth transistor and a fifth transistor. The fourth transistor is coupled between the second node and the initialization power source, and includes a gate electrode coupled to an (i+2)th initialization control line. The fifth transistor is coupled between the initialization power source and the organic light emitting diode, and includes a gate electrode coupled to the (i+2)th initialization control line.

In an exemplary embodiment, each of the pixels further includes a fourth transistor and a fifth transistor. The fourth transistor is coupled between the second node and the initialization power source, and includes a gate electrode coupled to an (i+3)th initialization control line. The fifth transistor is coupled between the initialization power source and the organic light emitting diode, and includes a gate electrode coupled to the (i+3)th initialization control line.

In an exemplary embodiment, each of the pixels further includes a sixth transistor and a second capacitor. The sixth transistor is coupled between the organic light emitting diode and the second electrode of the driving transistor, and includes a gate electrode coupled to an emission control line. The second capacitor is coupled between the first node and the first power source.

In an exemplary embodiment, the data driver is coupled to a plurality of output lines, and the organic light emitting display device further includes a plurality of demultiplexers configured to selectively couple the data lines and the output lines.

In an exemplary embodiment, the organic light emitting display device further includes a controller configured to control the demultiplexers such that the data signal is simultaneously supplied to two or more data lines.

In an exemplary embodiment, each of the demultiplexers includes a plurality of demultiplexer switches coupled between the data lines and the output lines. A first group of the demultiplexer switches is turned on by a first demultiplexer control signal transmitted by the controller to couple a first output line to two or more data lines, and a second group of the demultiplexer switches is turned on by a second demultiplexer control signal transmitted by the controller to couple a second output line to two or more data lines.

In an exemplary embodiment, the controller alternately supplies the first demultiplexer control signal and the second demultiplexer control signal during one horizontal period.

In an exemplary embodiment, a voltage of the initialization power source is set to be lower than a voltage of the data signal.

BRIEF DESCRIPTION OF THE DRAWINGS

The above and other features of the present disclosure will become more apparent by describing in detail exemplary embodiments thereof with reference to the accompanying drawings, in which.

DETAILED DESCRIPTION

Figure 1:
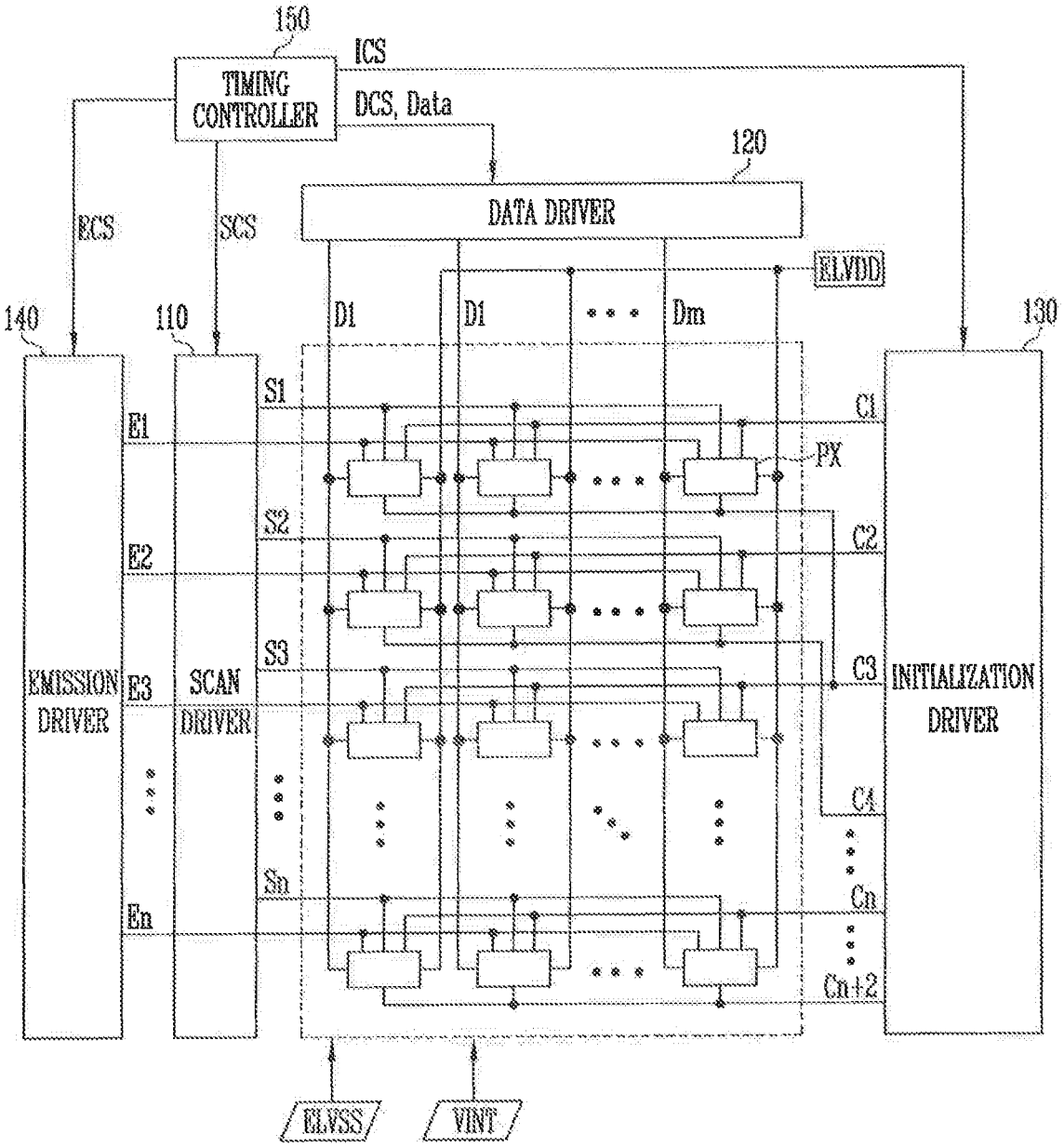
FIG. 1 is a schematic configuration diagram of an organic light emitting display device according to an exemplary embodiment of the present disclosure.

Exemplary embodiments of the present disclosure will be described more fully hereinafter with reference to the accompanying drawings. Like reference numerals may refer to like elements throughout the accompanying drawings.

It will be understood that, although the terms "first", "second", etc. may be used herein to describe various elements, these elements should not be limited by these terms. These terms are only used to distinguish one element from another element. Thus, a "first" element described below may also be termed a "second" element without departing from the teachings of the present disclosure. As used herein, the singular forms are intended to include the plural forms as well, unless the context clearly indicates otherwise.

It will be understood that when a component is referred to as being "on", "connected to", "coupled to", or "adjacent to" another component, it can be directly on, connected, coupled, or adjacent to the other component, or intervening components may be present. It will also be understood that when a component is referred to as being "between" two components, it can be the only component between the two components, or one or more intervening components may also be present.

FIG. 1 is a schematic configuration diagram of an organic light emitting display device according to an exemplary embodiment of the present disclosure.

Referring to FIG. 1, in an exemplary embodiment, an organic light emitting display device includes a plurality of pixels PX, a scan driver 110, a data driver 120, an initialization driver 130, an emission driver 140, and a timing controller 150.

The pixels PX are coupled to scan lines S1 to Sn, initialization control lines C1 to Cn+2, emission control lines E1 to En, and data lines D1 to Dm (n and m are positive integers). The pixels PX are arranged in a matrix form.

The pixels PX are coupled to a first power source ELVDD, a second power source ELVSS, and an initialization power source VINT.

The pixels PX are selected in units of horizontal lines, corresponding to a scan signal supplied from the scan lines S1 to Sn. The pixels PX selected by the scan signal emit light with a luminance corresponding to a data signal supplied from the data lines D1 to Dm.

An organic light emitting diode included in each of the pixels PX may be initialized to the voltage of the initialization power source VINT when an initialization control signal is supplied to the initialization control lines C1 to Cn+2. For example, pixels PX located on an ith (i is a positive integer) horizontal line may be initialized when the initialization control signal is supplied to an ith initialization control line Ci.

In an exemplary embodiment, the pixels PX are coupled to a plurality of initialization control lines. For example, the pixels PX located on the ith horizontal line may be coupled to the ith initialization control line Ci and an (i+2)th initialization control line Ci+2. However, the coupling relationship between the pixels PX and the initialization control lines C1 to Cn+2 may be variously modified according to the structure of the pixels PX.

The emission time of the pixels PX is controlled by an emission control signal supplied from the emission control lines E1 to En.

The scan driver 110 is coupled to the scan lines S1 to Sn, and supplies a scan signal to the scan lines S1 to Sn in response to a scan driving control signal SCS provided by the timing controller 150.

In an exemplary embodiment, the scan driver 110 is configured with a plurality of stage circuits, and sequentially supplies a scan signal to the scan lines S1 to Sn. When the scan signal is sequentially supplied to the scan lines S1 to Sn, the pixels PX are selected in units of horizontal lines. To this end, the scan signal may be set to a gate-on voltage at which transistors included in the pixels PX can be turned on.

The data driver 120 is coupled to the data lines D1 to Dm, and supplies a data signal to the data lines D1 to Dm in response to a data driving control signal DCS provided by the timing controller 150.

In an exemplary embodiment, the data driver 120 converts image data Data, which is in a digital form and is provided by the timing controller 150, to a data signal in an analog form, and outputs the data signal to the data lines D1 to Dm. The data signal output to the data lines D1 to Dm is input to pixels PX located on a horizontal line selected by a scan signal.

The initialization driver 130 is coupled to the initialization control lines C1 to Cn+2, and supplies an initialization control signal to the initialization control lines C1 to Cn+2 in response to an initialization driving control signal ICS provided by the timing controller 150.

The initialization control signal is used to initialize an organic light emitting diode and a driving transistor, which are included in each of the pixels PX. To this end, the initialization control signal may be set to the gate-on voltage at which the transistors included in the pixels PX can be turned on.

The emission driver 140 is coupled to the emission control lines E1 to En, and supplies an emission control signal to the emission control lines E1 to En in response to an emission driving control signal ECS provided by the timing controller 150.

The emission control signal is used to control the emission time of the pixels PX. To this end, the emission control signal may be set to a gate-off voltage at which the transistors included in the pixels PX can be turned off.

The timing controller 150 may convert image data input from the outside to image data Data suitable for image display, and supply the image data Data to the data driver 120.

The timing controller 150 may generate the data driving control signal DCS, the scan driving control signal SCS, the initialization driving control signal ICS, and the emission driving control signal ECS, corresponding to control signals supplied from the outside.

The scan driving control signal SCS is supplied to the scan driver 110, the data driving control signal DCS is supplied to the data driver 120, the initialization driving control signal ICS is supplied to the initialization driver 130, and the emission driving control signal ECS is supplied to the emission driver 140.

In an exemplary embodiment, the scan driver 110 supplies the scan signal to overlap with the initialization control signal. In addition, the width of the scan signal is set to be larger than the width of the initialization control signal.

For example, during a first period of one frame, the scan signal supplied to an ith (i is a positive integer) scan line and the initialization control signal supplied to an ith initialization control line overlap with each other. For example, when the width of the scan signal is set to two horizontal periods and the width of the initialization control signal is set to one horizontal period, the scan signal and the initialization control signal may overlap with each other during one horizontal period.

Although (n+2) initialization control lines C1 to Cn+2 are illustrated in FIG. 1, exemplary embodiments of the present disclosure are not limited thereto. For example, in an exemplary embodiment, dummy initialization control lines may be additionally formed so as to stably driver the organic light emitting display device.

In addition, although the scan driver 110, the data driver 120, the initialization driver 130, the emission driver 140, and the timing controller 150 are illustrated as separate components in FIG. 1, exemplary embodiments of the present disclosure are not limited thereto. For example, in an exemplary embodiment, at least some of the components may be integrated with one another.

The scan driver 110, the data driver 120, the initialization driver 130, the emission driver 140, and the timing controller 150 may be packaged in various ways including, for example, chip on glass, chip on plastic, tape carrier package, chip on film, etc.

Figure 2:
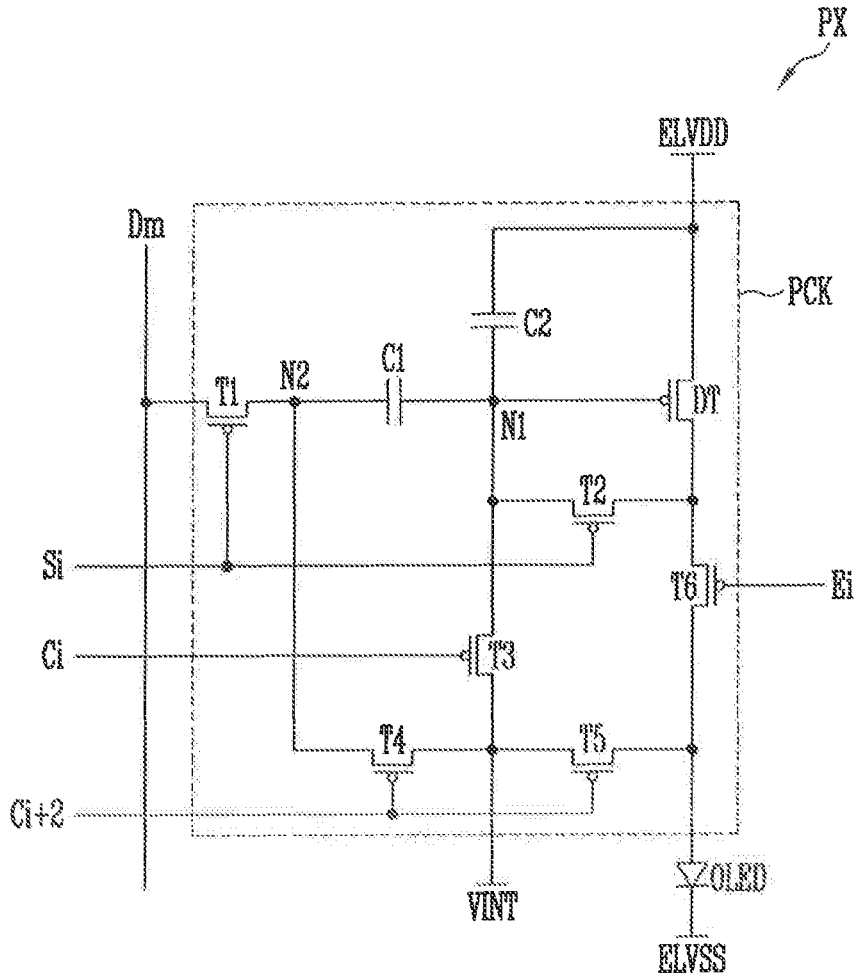
FIG. 2 is a diagram illustrating a pixel according to an exemplary embodiment of the present disclosure.

FIG. 2 is a diagram illustrating a pixel according to an exemplary embodiment of the present disclosure.

For convenience of explanation, only a single pixel PX coupled to an ith scan line and an mth (m is a positive integer) data line Dm is illustrated in FIG. 2. In an exemplary embodiment, all of the pixels PX may be configured in a similar manner as the pixel PX illustrated in FIG. 2.

Referring to FIG. 2, in an exemplary embodiment, the pixel PX includes a pixel circuit PCK and an organic light emitting diode OLED.

An anode electrode of the organic light emitting diode OLED may be coupled to the pixel circuit PCK, and a cathode electrode of the organic light emitting diode OLED may be coupled to a second power source ELVSS.

The organic light emitting diode OLED may generate light with a predetermined luminance based on a driving current supplied from the pixel circuit PCK.

A first power source ELVDD may be set to a voltage higher than that of the second power source ELVSS such that a current flows through the organic light emitting diode OLED.

The pixel circuit PCK may control an amount of current flowing from the first power source ELVDD to the second power source ELVSS via the organic light emitting diode OLED, corresponding to a data signal. To this end, in an exemplary embodiment, the pixel circuit PCK includes a driving transistor DT, a first transistor T1, a second transistor T2, a third transistor T3, a fourth transistor T4, a fifth transistor T5, a sixth transistor T6, a first capacitor C1, and a second capacitor C2.

A first electrode of the driving transistor DT is coupled to the first power source ELVDD, and a second electrode of the driving transistor DT is coupled to a first electrode of the sixth transistor T6. In addition, a gate electrode of the driving transistor DT is coupled to a first node N1.

The driving transistor DT supplies a current corresponding to a voltage applied to the first node N1 to the first electrode of the sixth transistor T6.

The first transistor T1 is coupled between the data line Dm and a second node N2. For example, a first electrode of the first transistor T1 is coupled to the data line Dm, and a second electrode of the first transistor T1 is coupled to the second node N2. In addition, a gate electrode of the first transistor T1 is coupled to the ith scan line Si.

The first transistor T1 is turned on when a scan signal is supplied to the ith scan line Si. As a result, the data line Dm and the second node N2 are electrically coupled to each other.

The second transistor T2 is coupled between the second electrode of the driving transistor DT and the first node N1. For example, a first electrode of the second transistor T2 is coupled to the second electrode of the driving transistor DT, and a second electrode of the second transistor T2 is coupled to the first node N1. In addition, a gate electrode of the second transistor T2 is coupled to the ith scan line Si.

The second transistor T2 is turned on when the scan signal is supplied to the ith scan line Si. As a result, the driving transistor DT is diode-coupled.

The third transistor T3 is coupled between the first node N1 and an initialization power source VINT. For example, a first electrode of the third transistor T3 is coupled to the first node N1, and a second electrode of the third transistor T3 is coupled to the initialization power source VINT. In addition, a gate electrode of the third transistor T3 is coupled to an ith initialization control line Ci.

The third transistor T3 is turned on when an initialization control signal is supplied to the ith initialization control line Ci. As a result, the voltage of the initialization power source VINT is supplied to the first node N1.

In an exemplary embodiment, the voltage of the initialization power source VINT is set lower than the voltage of the data signal.

The fourth transistor T4 is coupled between the second node N2 and the initialization power source VINT. For example, a first electrode of the fourth transistor T4 is coupled to the second node N2, and a second electrode of the fourth transistor T4 is coupled to the initialization power source VINT. In addition, a gate electrode of the fourth transistor T4 is coupled to an (i+2)th initialization control line Ci+2.

The fourth transistor T4 is turned on when an initialization control signal is supplied to the (i+2)th initialization control line Ci+2. As a result, the voltage of the initialization power source VINT is supplied to the first node N1.

The fifth transistor T5 is coupled between the organic light emitting diode OLED and the initialization power source VINT. For example, a first electrode of the fifth transistor T5 is coupled to the anode electrode of the organic light emitting diode OLED, and a second electrode of the fifth transistor T5 is coupled to the initialization power source VINT. In addition, a gate electrode of the fifth transistor T5 is coupled to the (i+2)th initialization control line Ci+2.

The fifth transistor T5 is turned on when the initialization control signal is supplied to the (i+2)th initialization control line Ci+2. As a result, the voltage of the initialization power source VINT is supplied to the anode electrode of the organic light emitting diode OLED.

The sixth transistor T6 is coupled between the driving transistor DT and the organic light emitting diode OLED. For example, the first electrode of the sixth transistor T6 is coupled to the second electrode of the driving transistor DT, and a second electrode of the sixth transistor T6 is coupled to the anode electrode of the organic light emitting diode OLED. In addition, a gate electrode of the sixth transistor T6 is coupled to an ith emission control line Ei.

The sixth transistor T6 is turned off when an emission control signal is supplied to the ith emission control line Ei, and is turned on when the emission control signal is not supplied to the ith emission control line Ei.

The first capacitor C1 is coupled between the first node N1 and the second node N2. The first capacitor C1 charges a voltage between the first node N1 and the second node N2. For example, the first capacitor C1 charges a voltage corresponding to the data signal and a threshold voltage of the driving transistor DT.

The second capacitor C2 is coupled between the first node N1 and the first power source ELVDD. The second capacitor C2 charges a voltage between the first node N1 and the first power source ELVDD. For example, the second capacitor C2 charges a voltage corresponding to the threshold voltage of the driving transistor DT.

FIGS. 3A, 3B, 3C, and 3D are diagrams illustrating an operation of the pixel of FIG. 2. FIG. 4 is a waveform diagram illustrating a driving method of the pixel of FIG. 2.

For convenience of description, an emission control signal supplied to the ith emission control line Ei, a scan signal supplied to the ith scan line Si, an initialization control signal supplied to the ith initialization control line Ci, and an initialization control signal supplied to the (i+2)th initialization control line Ci+2 during one frame period are illustrated in FIG. 4.

The one frame may be divided into a first period t1, a second period t2, a third period t3, and a fourth period t4. Here, each of the first period t1, the second period t2, and the third period t3 may correspond to one horizontal period.

Figure 3A:
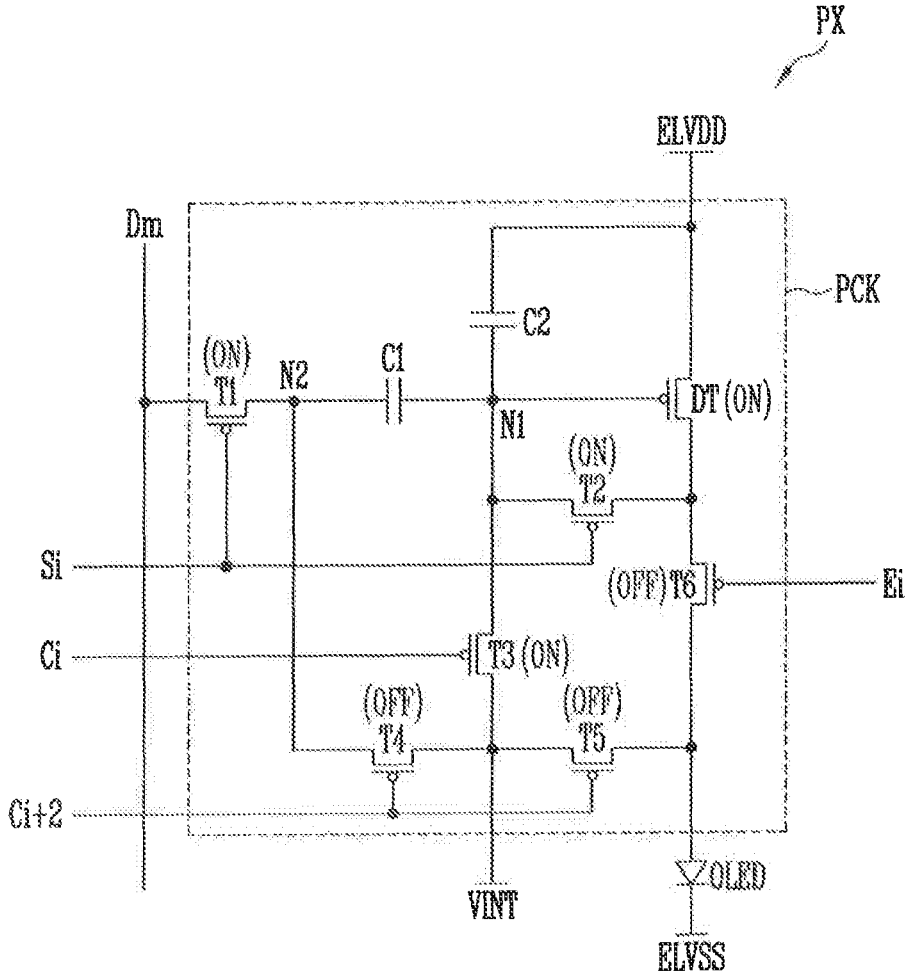
FIGS. 3A, 3B, 3C, and 3D are diagrams illustrating an operation of the pixel of FIG. 2.
Figure 4:
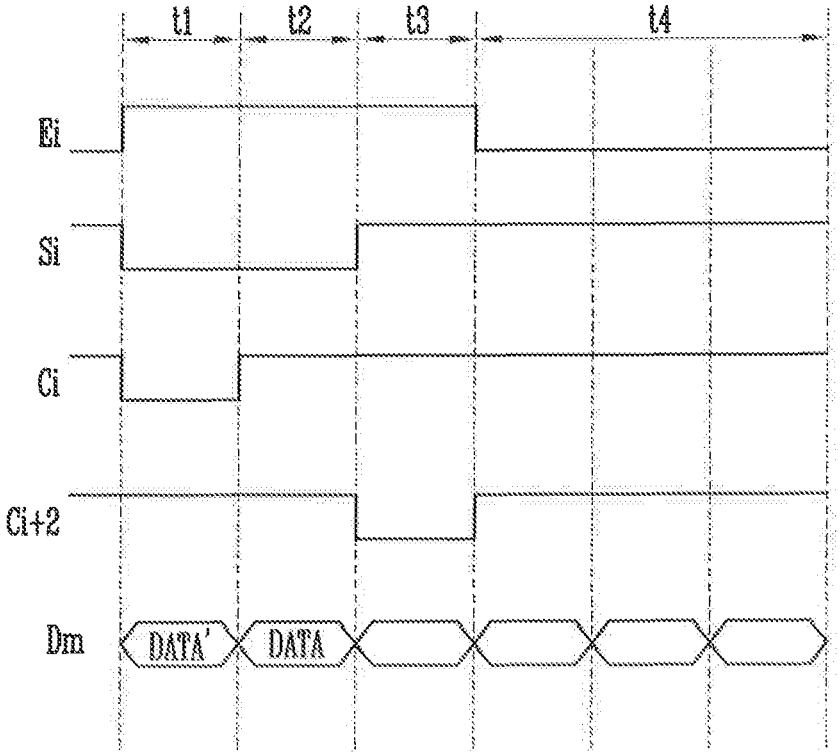
FIG. 4 is a waveform diagram illustrating a driving method of the pixel of FIG. 2.

Referring to FIGS. 3A and 4, an emission control signal is supplied to the ith emission control line Ei during the first period t1, the second period t2, and the third period t3. When the emission control signal having the gate-off voltage is supplied, the sixth transistor T6 is turned off.

When the sixth transistor T6 is turned off, the second electrode of the driving transistor DT and the anode electrode of the organic light emitting diode OLED are electrically disconnected from each other. Therefore, the pixel PX is set to a non-emission state during the first period t1, the second period t2, and the third period t3.

In addition, a scan signal is supplied to the ith scan line Si during the first period t1 and the second period t2. When the scan signal is supplied, the first transistor T1 and the second transistor T2 are turned on.

When the first transistor T1 is turned on, a data signal from the data line Dm is supplied to the second node N2. At this time, the first capacitor C1 stores a voltage corresponding to the second node N2. For example, the first capacitor C1 stores a voltage DATA' corresponding to the data signal supplied during the first period t1.

When the second transistor T2 is turned on, the second electrode of the driving transistor DT and the first node N1 are electrically coupled to each other. Thus, when the second transistor T2 is turned on, the driving transistor DT is diode-coupled.

In addition, an initialization control signal is supplied to the ith initialization control line Ci during the first period t1. When the initialization control signal is supplied to the ith initialization control line Ci, the third transistor T3 is turned on.

When the third transistor T3 is turned on, the voltage of the initialization power source VINT is supplied to the first node N1. At this time, the gate electrode of the driving transistor DT is initialized to the voltage of the initialization power source VINT.

Figure 3B:
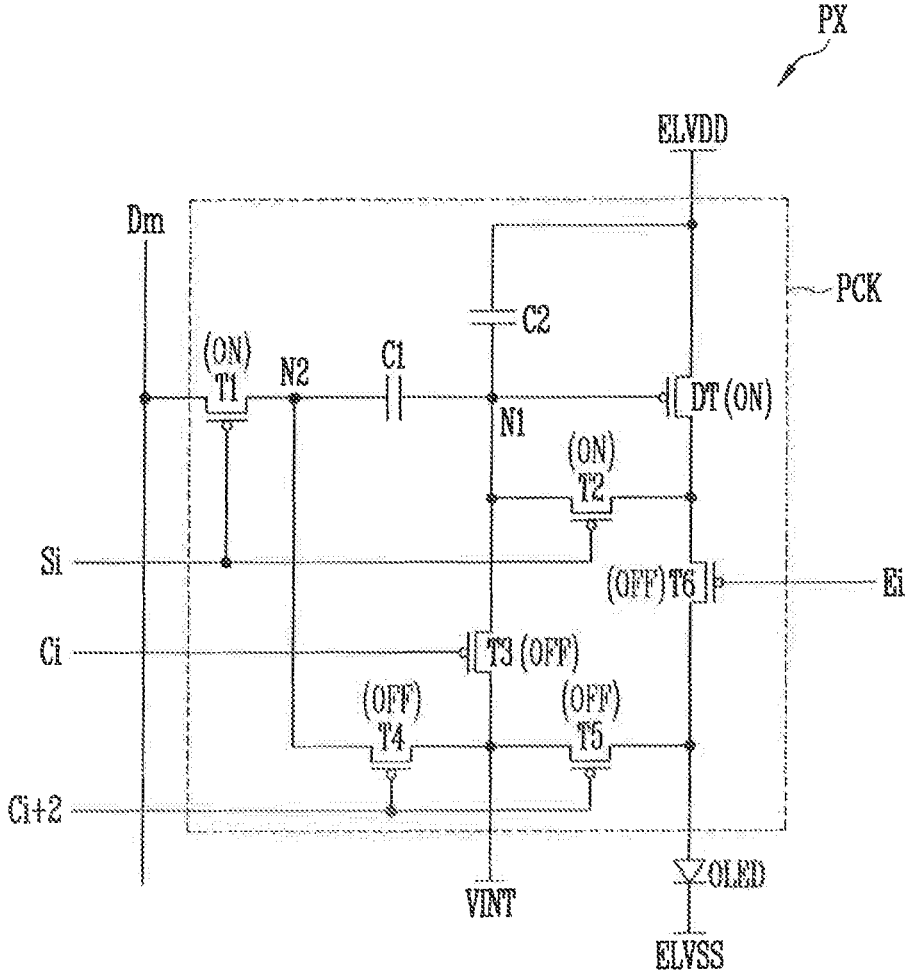

Referring to FIGS. 3B and 4, the supply of the initialization control signal to the ith initialization control line Ci is stopped during the second period t2. When the supply of the initialization control signal is stopped, the third transistor T3 is turned off.

The third transistor T3 is turned off during the second period t2, but the first transistor T1 and the second transistor T2 maintain a turn-on state.

In the state in which the first transistor T1 is turned on, the data signal from the data line Dm is supplied to the second node N2. At this time, the first capacitor C1 stores a voltage corresponding to the voltage of the second node N2. For example, the first capacitor C1 stores a voltage DATA corresponding to the data signal supplied during the second period t2.

Also, in the state in which the second transistor T2 is turned on, the driving transistor DT maintains a state in which it is diode-coupled. Since the first node N1 is in a state in which it is set to the voltage of the initialization power source VINT, which is lower than the voltage of the data signal, the driving transistor DT is turned on.

At this time, since the third transistor T3 is in a turn-off state, the voltage of the first node N1 is increased up to "VDD+Vth" during the second period t2 (here, VDD is the voltage of the first power source ELVDD, and Vth is the threshold voltage of the driving transistor DT). When the voltage of the first node N1 is increased up to "VDD+Vth," the driving transistor DT is turned off.

In addition, the second capacitor C2 stores the voltage "VDD+Vth" of the first node N1.

Figure 3C:
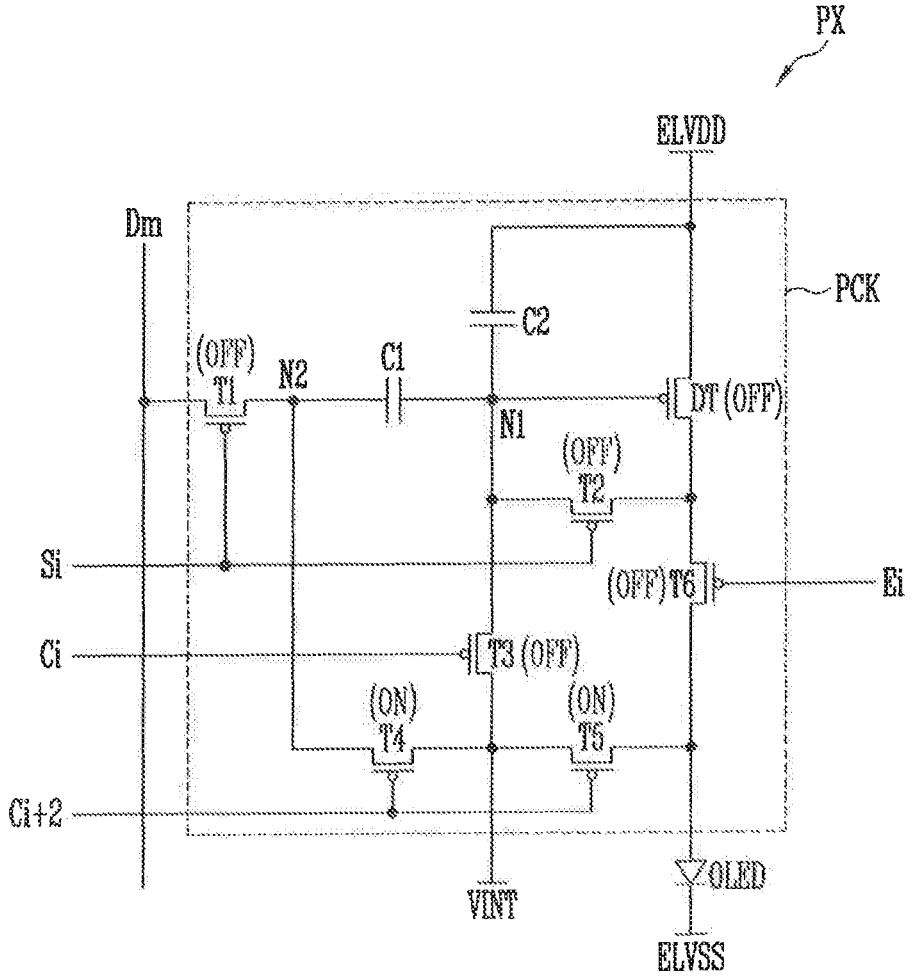

Referring to FIGS. 3C and 4, an initialization control signal is supplied to the (i+2)th initialization control line Ci+2 during the third period t3. When the initialization control signal is supplied to the (i+2)th initialization control line Ci+2, the fourth transistor T4 and the fifth transistor T5 are turned on.

When the fourth transistor T4 is turned on, the voltage of the initialization power source VINT is supplied to the second node N2. Accordingly, the voltage of the second node N2 is changed to the voltage "Vinit" of the initialization power source VINT.

In addition, as the voltage of the second node N2 is changed, the voltage of the first node N1 is changed to "VDD+Vth−(DATA−Vinit)."

Also, when the fifth transistor T5 is turned on, the anode electrode of the organic light emitting diode OLED is initialized to the voltage of the initialization power source VINT. In this case, an organic capacitor equivalently formed at the organic light emitting diode OLED is discharged.

Figure 3D:
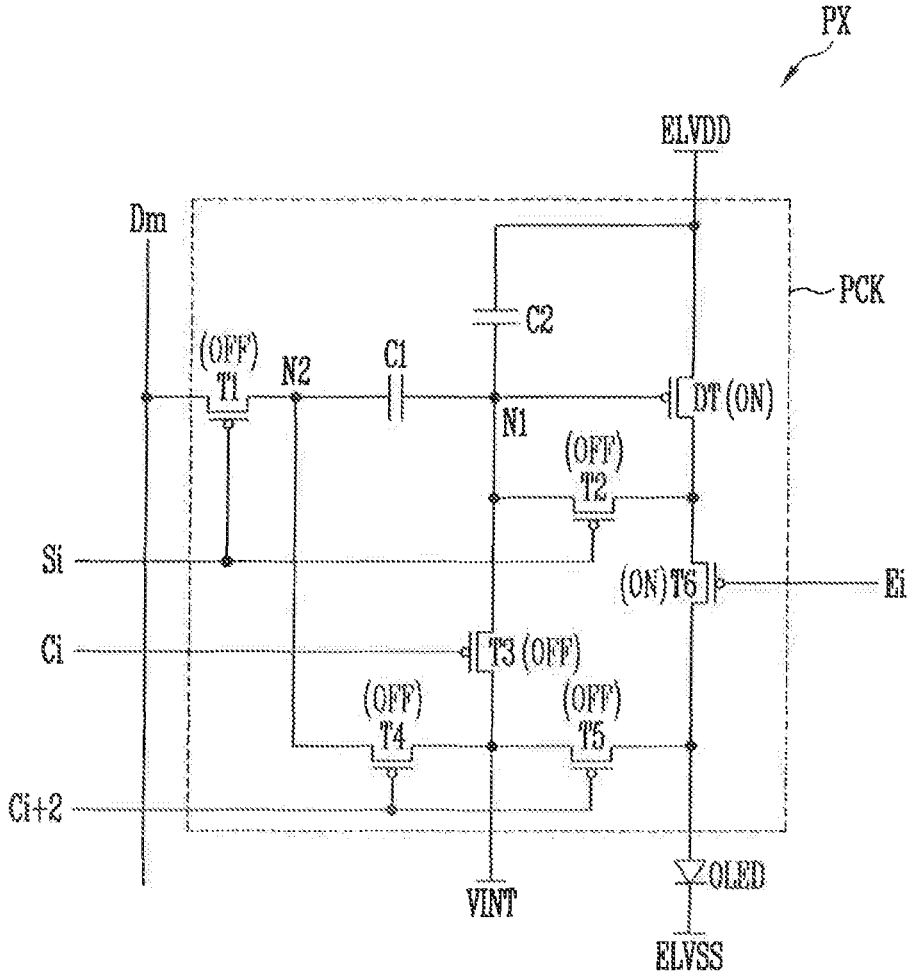

Referring to FIGS. 3D and 4, the supply of the emission control signal to the ith emission control line Ei is stopped during the fourth period t4. When the supply of the emission control signal is stopped, the sixth transistor T6 is turned on.

When the sixth transistor T6 is turned on, a current path is formed from the first power source ELVDD to the second power source ELVSS via the organic light emitting diode OLED. Thus, the organic light emitting diode OLED generates light with a predetermined luminance corresponding to an amount of current supplied from the driving transistor DT.

In this case, a driving current Ids supplied to the organic light emitting diode OLED may be expressed as shown in Equation 1.

$$Ids=k(Vgs-Vth)^2 \quad \text{Equation 1}$$

In Equation 1, k denotes a proportional coefficient determined by structural and physical characteristics of the driving transistor DT, Vgs denotes a gate-source voltage of the driving transistor DT, and Vth denotes the threshold voltage of the driving transistor DT.

The gate-source voltage of the driving transistor DT means a difference in voltage between the first node N1 and the first power source ELVDD. As described above, the voltage of the first node N1 is "VDD+Vth−(DATA−Vinit)," and the voltage of the first power source ELVDD is "VDD."

Therefore, the driving current Ids may be expressed as shown in Equation 2.

$$Ids=k(VDD+Vth+Vinit-\text{DATA}-VDD-Vth)_2 \quad \text{Equation 2}$$

Equation 3 is derived by summarizing Equation 2.

$$Ids=k(Vinit-\text{DATA})^2 \quad \text{Equation 3}$$

Consequently, as shown in Equation 3, the driving current Ids does not rely on the threshold voltage Vth of the driving transistor DT and the voltage VDD of the first power source ELVDD. That is, in the pixel and the organic light emitting display device including the same according to exemplary embodiments of the present disclosure, the threshold voltage Vth of the driving transistor DT can be compensated, and a voltage drop of the first power source ELVDD can be compensated.

According to exemplary embodiments of the present disclosure, a turn-on time of the first and second transistors T1 and T2 overlaps a turn-on time of the third transistor T3. Further, according to exemplary embodiments, the turn-on time of the first and second transistors T1 and T2 is longer than the turn-on time of the third transistor T3.

Figure 5:
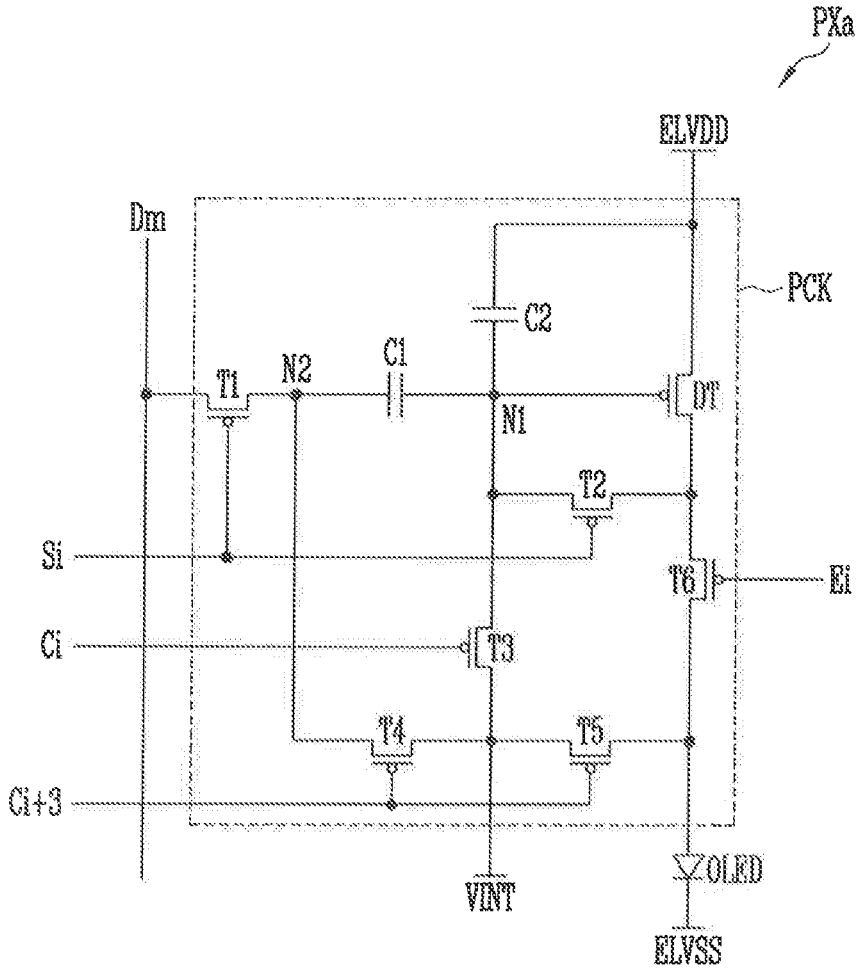
FIG. 5 is a diagram illustrating a pixel according to an exemplary embodiment of the present disclosure.
Figure 6:
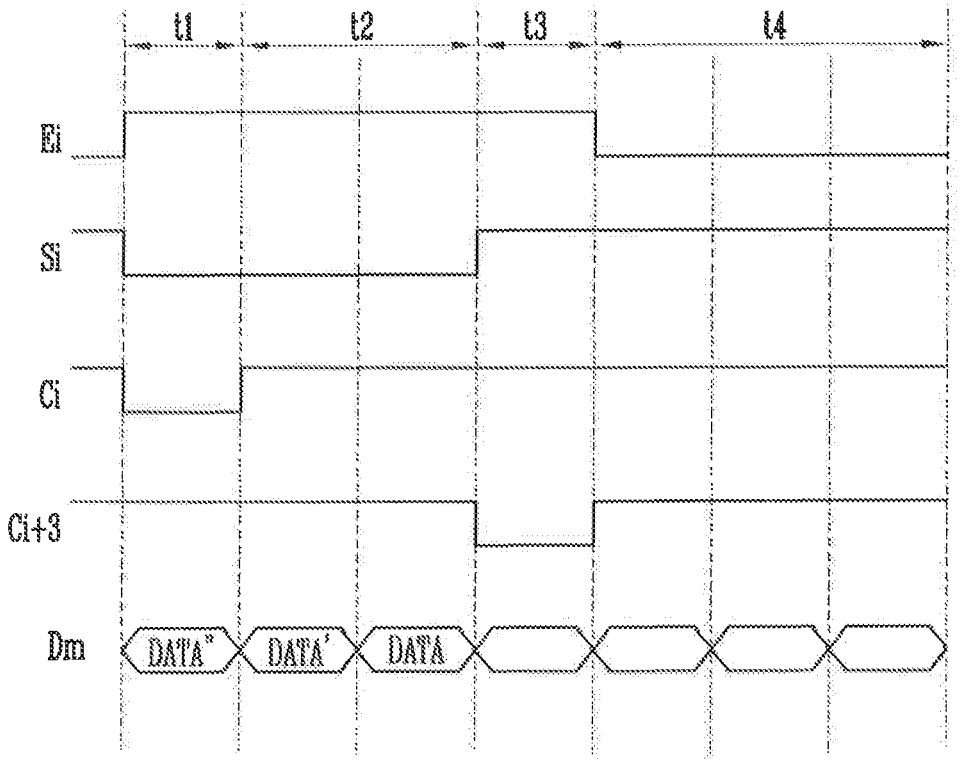
FIG. 6 is a waveform diagram illustrating a driving method of the pixel of FIG. 5.

FIG. 5 is a diagram illustrating a pixel according to an exemplary embodiment of the present disclosure. FIG. 6 is a waveform diagram illustrating a driving method of the pixel of FIG. 5.

Hereinafter, for convenience of explanation, a further description of components substantially similar to those previously described above may be omitted.

Referring to FIGS. 5 and 6, in the pixel PXa according to an exemplary embodiment, an initialization control signal is supplied to an (i+3)th initialization control line Ci+3. The gate electrode of each of the fourth transistor T4 and the fifth transistor T5 is coupled to the (i+3)th initialization control line Ci+3.

In addition, the width of a scan signal is set to three horizontal periods. Accordingly, the second period t2 in which the threshold voltage of the driving transistor DT is compensated is set to two horizontal periods.

For example, the supply of the initialization control signal to the ith initialization control line Ci is stopped during the second period t2. When the supply of the initialization control signal is stopped, the third transistor T3 is turned off.

The third transistor T3 is turned off during the second period t2, but the first transistor T1 and the second transistor T2 maintain the turn-on state.

In the state in which the first transistor T1 is turned on, the data signal from the data line Dm is supplied to the second node N2.

In an exemplary embodiment, since the second period t2 is set to two horizontal periods, two data signals are sequentially supplied to the second node N2 during the second period t2. Consequently, the first capacitor C1 stores a voltage DATA corresponding to the last supplied data signal.

Since the second transistor T2 is turned on and the third transistor T3 is turned off, the driving transistor DT is diode-coupled to compensate for the threshold voltage during the two horizontal periods.

According to exemplary embodiments of the present disclosure, the supply time of the scan signal is increased, and as a result, a long compensation time is secured. For example, according to exemplary embodiments, the supply time of the scan signal is increased, and as a result, the compensation time for which the threshold voltage of the driving transistor DT is compensated is sufficiently secured.

Figure 7:
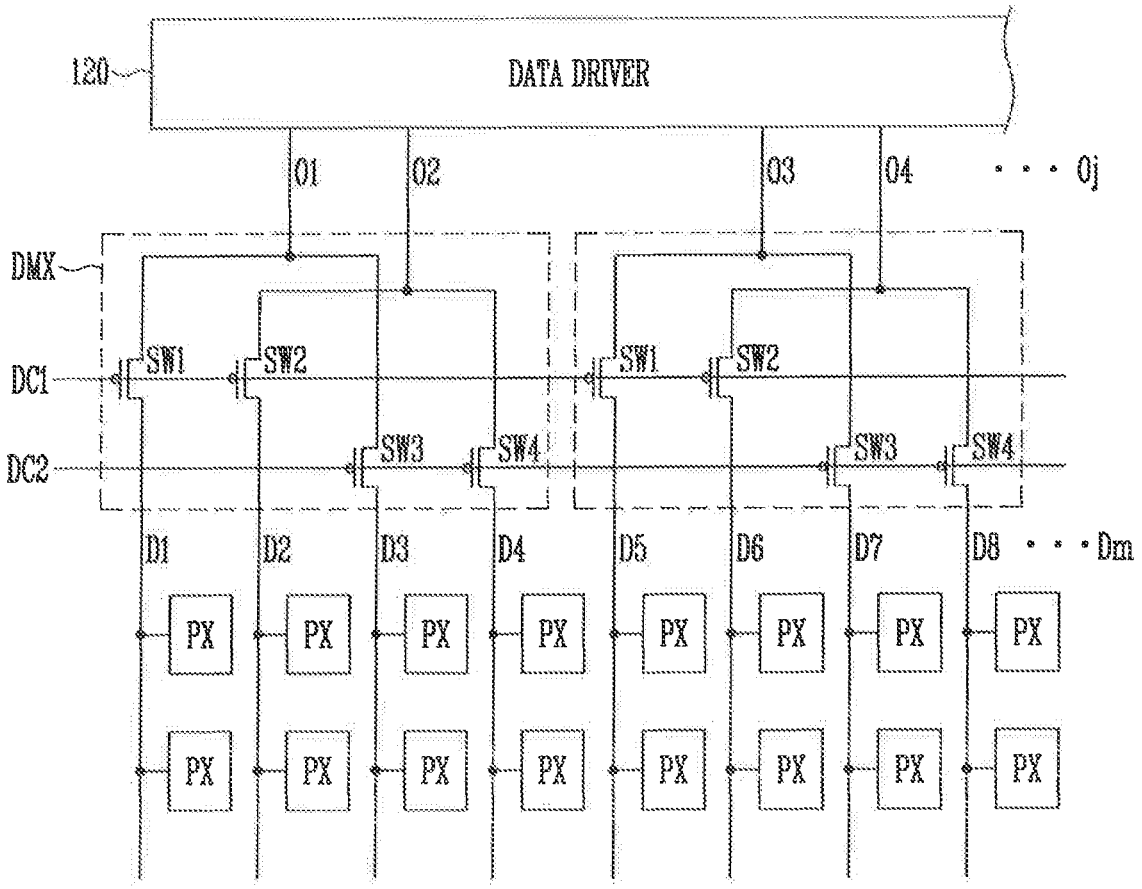
FIG. 7 is a partial configuration diagram of an organic light emitting display device according to an exemplary embodiment of the present disclosure.
Figure 8:
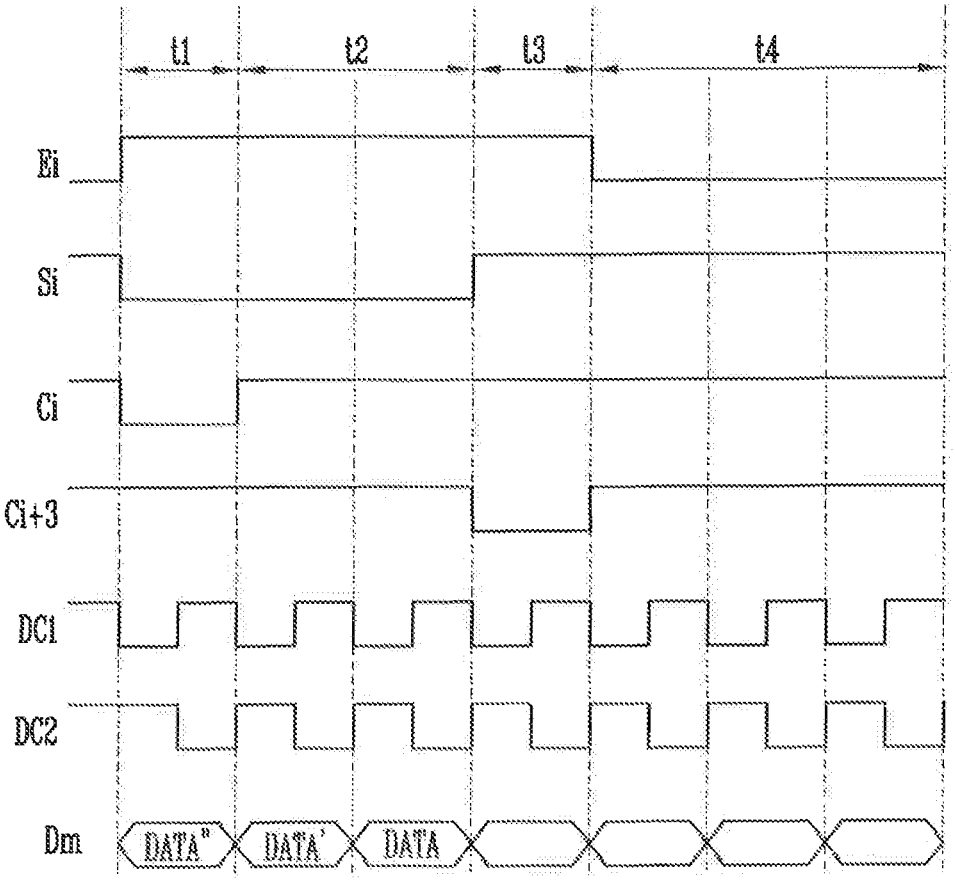
FIG. 8 is a waveform diagram illustrating a driving method of the organic light emitting display device of FIG. 7.

FIG. 7 is a partial configuration diagram of an organic light emitting display device according to an exemplary embodiment of the present disclosure. FIG. 8 is a waveform diagram illustrating a driving method of the organic light emitting display device of FIG. 7.

Referring to FIG. 7, in an exemplary embodiment, the organic light emitting display device includes demultiplexers DMX and a controller that controls the demultiplexers DMX. For convenience of description, two demultiplexers DMX are illustrated in FIG. 7. However, exemplary embodiments of the present disclosure are not limited thereto.

The data driver 120 is coupled to output lines O1 to Oj, and supplies a data signal to the output lines O1 to Oj.

The demultiplexers DMX are located between the output lines O1 to Oj and the data lines D1 to Dm, and selectively couple the output lines O1 to Oj and the data lines D1 to Dm.

In an exemplary embodiment, each of the demultiplexers DMX includes demultiplexer switches SW1 to SW4 coupled between the data lines D1 to Dm and the output lines O1 to Oj. The demultiplexer switches SW1 to SW4 include a first demultiplexer switch SW1 coupled between a first output line O1 and a first data line D1, a second demultiplexer switch SW2 coupled between a second output line O2 and a second data line D2, a third demultiplexer switch SW3 coupled between the first output line O1 and a third data line D3, and a fourth demultiplexer switch SW4 coupled between the second output line O2 and a fourth data line D4.

The controller controls the demultiplexers DMX such that the data signal is simultaneously supplied to two or more data lines. The controller may be, for example, the timing controller 150 described above.

In an exemplary embodiment, the first demultiplexer switch SW1 and the second demultiplexer switch SW2 are turned on in response to a first demultiplexer control signal DC1. The third demultiplexer switch SW3 and the fourth demultiplexer switch SW4 are turned on in response to a second demultiplexer control signal DC2. The first and second demultiplexer control signals DC1 and DC2 are transmitted by the controller (e.g., the timing controller 150).

According to exemplary embodiments, a first group of the demultiplexer switches is turned on by the first demultiplexer control signal DC1 to couple a first output line to two or more data lines, and a second group of the demultiplexer switches is turned on by the second demultiplexer control signal DC2 to couple a second output line to two or more data lines.

It is to be understood that the structure of the demultiplexers DMX is not limited to the structure illustrated in FIG. 7.

Referring to FIG. 8, the first demultiplexer control signal DC1 and the second demultiplexer control signal DC2 are alternately supplied during one horizontal period. The pixel PX coupled to the ith scan line Si and the mth data line Dm stores a voltage corresponding to the data signal during the second period t2.

Referring to FIGS. 5 and 8, in an exemplary embodiment, the second period t2 is set to two horizontal periods, and thus, two data signals are sequentially supplied to the second node N2 during the second period t2. Consequently, the first capacitor C1 stores a voltage DATA corresponding to the last supplied data signal.

Since the data signal is supplied twice to the demultiplexers DMX, the period in which the last data signal is supplied to the pixel PX is a ½ horizontal period. However, the second period t2 that is a compensation time for which the threshold voltage of the driving transistor DT is compensated is set to two horizontal periods, and thus, a compensation time of the ½ horizontal period or more can be secured.

As described above, according to exemplary embodiments of the present disclosure, the display quality of a high-resolution and large-area display device is improved. For example, according to exemplary embodiments, the supply time of a scan signal is increased, and as a result, the compensation time for which the threshold voltage of the driving transistor is compensated can be sufficiently secured. Further, a voltage drop of the power source can be compensated.

While the present disclosure has been particularly shown and described with reference to the exemplary embodiments thereof, it will be understood by those of ordinary skill in the art that various changes in form and detail may be made therein without departing from the spirit and scope of the present disclosure as defined by the following claims.

What is claimed is:

1. A pixel, comprising:

an organic light emitting diode;

a driving transistor configured to control an amount of current supplied from a first power source to the organic light emitting diode, wherein the first power source is coupled to a first electrode of the driving transistor, and the current corresponds to a voltage of a first node;

a first transistor coupled between a data line and a second node, wherein the first transistor comprises a gate electrode coupled to an ith scan line, and i is a positive integer;

a first capacitor coupled between the first node and the second node;

a second transistor coupled between the first node and a second electrode of the driving transistor, wherein the second transistor comprises a gate electrode coupled to the ith scan line;

a third transistor coupled between the first node and an initialization power source, wherein the third transistor comprises a gate electrode coupled to an ith initialization control line; and a fourth transistor coupled between the second node and the initialization power source, wherein the fourth transistor comprises a gate electrode coupled to an (i+2)th initialization control line, wherein a turn-on time of the first and second transistors overlaps a turn-on time of the third transistor.

2. The pixel of claim 1, wherein the turn-on time of the first and second transistors is longer than the turn-on time of the third transistor.

3. The pixel of claim 2, further comprising:

a fifth transistor coupled between the initialization power source and the organic light emitting diode, wherein the fifth transistor comprises a gate electrode coupled to the (i+2)th initialization control line.

4. A pixel, comprising:

an organic light emitting diode;

a driving transistor configured to control an amount of current supplied from a first power source to the organic light emitting diode, wherein the first power source is coupled to a first electrode of the driving transistor, and the current corresponds to a voltage of a first node;

a first transistor coupled between a data line and a second node, wherein the first transistor comprises a gate electrode coupled to an ith scan line, and i is a positive integer;

a first capacitor coupled between the first node and the second node;

a second transistor coupled between the first node and a second electrode of the driving transistor, wherein the second transistor comprises a gate electrode coupled to the ith scan line;

a third transistor coupled between the first node and an initialization power source, wherein the third transistor comprises a gate electrode coupled to an ith initialization control line;

a fourth transistor coupled between the second node and the initialization power source, wherein the fourth transistor comprises a gate electrode coupled to an (i+3)th initialization control line; and a fifth transistor coupled between the initialization power source and the organic light emitting diode, wherein the fifth transistor comprises a gate electrode coupled to the (i+3)th initialization control line, wherein a turn-on time of the first and second transistors overlaps a turn-on time of the third transistor.

5. The pixel of claim 4, further comprising:

a sixth transistor coupled between the organic light emitting diode and the second electrode of the driving transistor, wherein the sixth transistor comprises a gate electrode coupled to an emission control line; and a second capacitor coupled between the first node and the first power source.

6. An organic light emitting display device, comprising:

a plurality of pixels;

a plurality of scan lines;

a plurality of data lines;

a plurality of initialization control lines, wherein the pixels are coupled to the scan lines, the data lines, and the initialization control lines;

a scan driver configured to supply a scan signal to the scan lines;

a data driver configured to supply a data signal to the data lines; and an initialization driver configured to supply an initialization control signal to the initialization control lines, wherein each of the pixels comprises:

an organic light emitting diode;

a driving transistor configured to control an amount of current supplied from a first power source to the organic light emitting diode, wherein the first power source is coupled to a first electrode of the driving transistor, and the current corresponds to a voltage of a first node;

a first transistor coupled between a data line and a second node, wherein the first transistor comprises a gate electrode coupled to an ith scan line, and i is a positive integer;

a first capacitor coupled between the first node and the second node;

a second transistor coupled between the first node and a second electrode of the driving transistor, wherein the second transistor comprises a gate electrode coupled to the ith scan line;

a third transistor coupled between the first node and an initialization power source, wherein the third transistor comprises a gate electrode coupled to an ith initialization control line; and a fourth transistor coupled between the second node and the initialization power source, wherein the fourth transistor comprises a gate electrode coupled to an (i+2)th initialization control line, wherein, during a first period of one frame, the scan signal supplied to the ith scan line and the initialization control signal supplied to the ith initialization control line overlap each other.

7. The organic light emitting display device of claim 6, wherein the one frame comprises a second period subsequent to the first period, and the scan driver supplies the scan signal to the ith scan line during the first period and the second period.

8. The organic light emitting display device of claim 7, wherein the initialization driver supplies the initialization control signal to the ith initialization control line during the first period.

9. The organic light emitting display device of claim 8, wherein the one frame further comprises a third period subsequent to the second period, and the initialization driver supplies the initialization control signal to the (i+2)th initialization control line during the third period.

10. The organic light emitting display device of claim 8, wherein the one frame further comprises a third period subsequent to the second period, and the initialization driver supplies the initialization control signal to an (i+3)th initialization control line during the third period.

11. The organic light emitting display device of claim 10, further comprising:

an emission driver configured to supply an emission control signal to a plurality of emission control lines coupled to the pixels.

12. The organic light emitting display device of claim 11, wherein the one frame further comprises a fourth period subsequent to the third period, and the emission driver supplies the emission control signal to an ith emission control line during the fourth period.

13. The organic light emitting display device of claim 6, wherein each of the pixels further comprises:

a fifth transistor coupled between the initialization power source and the organic light emitting diode, wherein the fifth transistor comprises a gate electrode coupled to the (i+2)th initialization control line.

14. An organic light emitting display device, comprising:

a plurality of pixels;

a plurality of scan lines;

a plurality of data lines;

a plurality of initialization control lines, wherein the pixels are coupled to the scan lines, the data lines, and the initialization control lines;

a scan driver configured to supply a scan signal to the scan lines;

a data driver configured to supply a data signal to the data lines; and an initialization driver configured to supply an initialization control signal to the initialization control lines, wherein each of the pixels comprises:

an organic light emitting diode;

a driving transistor configured to control an amount of current supplied from a first power source to the organic light emitting diode, wherein the first power source is coupled to a first electrode of the driving transistor, and the current corresponds to a voltage of a first node;

a first transistor coupled between a data line and a second node, wherein the first transistor comprises a gate electrode coupled to an ith scan line, and i is a positive integer;

a first capacitor coupled between the first node and the second node;

a second transistor coupled between the first node and a second electrode of the driving transistor, wherein the second transistor comprises a gate electrode coupled to the ith scan line;

a third transistor coupled between the first node and an initialization power source, wherein the third transistor comprises a gate electrode coupled to an ith initialization control line;

a fourth transistor coupled between the second node and the initialization power source, wherein the fourth transistor comprises a gate electrode coupled to an (i+3)th initialization control line; and a fifth transistor coupled between the initialization power source and the organic light emitting diode, wherein the fifth transistor comprises a gate electrode coupled to the (i+3)th initialization control line, wherein, during a first period of one frame, the scan signal supplied to the ith scan line and the initialization control signal supplied to the ith initialization control line overlap each other.

15. The organic light emitting display device of claim 14, wherein each of the pixels further comprises:

a sixth transistor coupled between the organic light emitting diode and the second electrode of the driving transistor, wherein the sixth transistor comprises a gate electrode coupled to an emission control line; and a second capacitor coupled between the first node and the first power source.

16. The organic light emitting display device of claim 6, wherein the data driver is coupled to a plurality of output lines, and the organic light emitting display device further comprises a plurality of demultiplexers configured to selectively couple the data lines and the output lines.

17. The organic light emitting display device of claim 16, further comprising:

a controller configured to control the demultiplexers such that the data signal is simultaneously supplied to two or more data lines.

18. The organic light emitting display device of claim 17, wherein each of the demultiplexers comprises a plurality of demultiplexer switches coupled between the data lines and the output lines, wherein a first group of the demultiplexer switches is turned on by a first demultiplexer control signal transmitted by the controller to couple a first output line to two or more data lines, and a second group of the demultiplexer switches is turned on by a second demultiplexer control signal transmitted by the controller to couple a second output line to two or more data lines.

19. The organic light emitting display device of claim 18, wherein the controller alternately supplies the first demultiplexer control signal and the second demultiplexer control signal during one horizontal period.

20. The organic light emitting display device of claim 6, wherein a voltage of the initialization power source is set to be lower than a voltage of the data signal.

* * * * *